US006315534B1

(12) United States Patent
Chou

(10) Patent No.: US 6,315,534 B1
(45) **Date of Patent: *Nov. 13, 2001**

(54) AIR COMPRESSOR HAVING EASILY ASSEMBLED STRUCTURE

(76) Inventor: Wen San Chou, No. 15, Lane 833, Wen Hsien Road, Tainan (TW), 704

( * ) Notice: Subject to any disclaimer, the term of this patent is extended or adjusted under 35 U.S.C. 154(b) by 0 days.

This patent is subject to a terminal disclaimer.

(21) Appl. No.: 09/460,288

(22) Filed: Dec. 11, 1999

Related U.S. Application Data

(63) Continuation-in-part of application No. 09/049,904, filed on Mar. 30, 1998, now Pat. No. 6,095,758.

(51) Int. Cl.[7] ..... F04B 39/10; F04B 17/00; F01B 9/00; F16H 1/12; F16H 1/20

(52) U.S. Cl. ..... 417/550; 417/360; 417/553; 92/140; 74/421 A; 74/421 R

(58) Field of Search ..... 417/550, 553, 417/545, 551, 423.14, 423.6, 360; 92/140; 74/421 A, 421 R

(56) References Cited

U.S. PATENT DOCUMENTS

| | | | | |
|---|---|---|---|---|
| 1,628,096 | * | 5/1927 | Worth | 417/458 |
| 2,506,751 | * | 5/1950 | Trask | 230/228 |
| 2,792,790 | * | 5/1957 | Capps | 103/178 |
| 4,090,410 | * | 5/1978 | Nakamura | 74/414 |
| 5,215,447 | * | 6/1993 | Wen | 417/415 |
| 5,655,887 | * | 8/1997 | Chou | 417/63 |
| 6,095,758 | * | 8/2000 | Chou | 417/63 |

* cited by examiner

*Primary Examiner*—Charles G. Freay
*Assistant Examiner*—Timothy P. Solak

(57) ABSTRACT

An air compressor includes a pressure gage attached to a cylinder housing, a compression device having a piston container slidably received in the cylinder housing for supporting a compression valve and a positioning block and a valve piece and a limiting piece. A motor is secured to a seat. A gear is rotatably secured to the seat and driven by the motor and includes a weight pivotally coupled to the piston container with a link. The elements may be secured onto the cylinder housing and the seat separately before the seat is secured to the cylinder housing.

1 Claim, 4 Drawing Sheets

AIR COMPRESSOR HAVING EASILY ASSEMBLED STRUCTURE

The present invention is a continuation-in-part of U.S. patent application Ser. No. 09/049,904, filed on Mar. 30, 1998, now U.S. Pat. No. 6,095,758.

BACKGROUND OF THE INVENTION

1. Field of the Invention

The present invention relates to an air compressor, and more particularly to an air compressor having an improved structure for allowing the air compressor to be easily and quickly assembled.

2. Description of the Prior Art

Typical air compressors comprise a single support member, and a large amount of elements and members required to be assembled onto the support member. Normally, the air compressors comprise a compact size such that the elements may not be easily and quickly assembled onto the single support member.

The present invention has arisen to mitigate and/or obviate the afore-described disadvantages of the conventional air compressors.

SUMMARY OF THE INVENTION

The primary objective of the present invention is to provide an air compressor including an improved structure for allowing the elements of the air compressor to be easily and quickly assembled together.

In accordance with one aspect of the invention, there is provided an air compressor comprising a cylinder housing including an outlet port, a pressure gage attached to the cylinder housing, a compression device including a piston container slidably received in the cylinder housing and including a post extended upward therefrom and including a disc provided on top of the post, the disc including a pin extended upward therefrom, a compression valve and a positioning block engaged onto the post and retained on the post with the disc, the post and the disc including at least one air inlet formed therein and communicating with an interior of the piston container, a valve piece engaged on the pin of the disc, a limiting piece including a fastening portion engaged with the pin for securing the valve piece on the pin of the disc, and a link including an upper portion pivotally secured to the piston container and including a bottom portion, a seat including an orifice formed therein, a motor secured to the seat and including a pinion engaged through the orifice of the seat, a transmission device including a gear rotatably securing to the seat at a pivot shaft and engaged with the pinion and driven by the motor via the pinion, the gear including a non-circular casing provided thereon, the gear including a first half having a thick toothed portion provided thereon for engaging with the pinion of the motor and including a second half having a thin toothed portion provided thereon for engaging with the pinion of the motor, a weight including a non-circular shape engaged in the non-circular casing and rotated in concert with the gear, the weight being engaged on the shaft and rotated in concert with the shaft, the weight including an axle extended therefrom and rotatably engaged through the lower portion of the link for moving the link up and down when the weight is rotated by the shaft, and means for securing the seat to the cylinder housing.

The seat includes at least one sleeve provided therein, and the cylinder housing includes at least one project ion extended therefrom and engaged into the sleeve of the seat.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
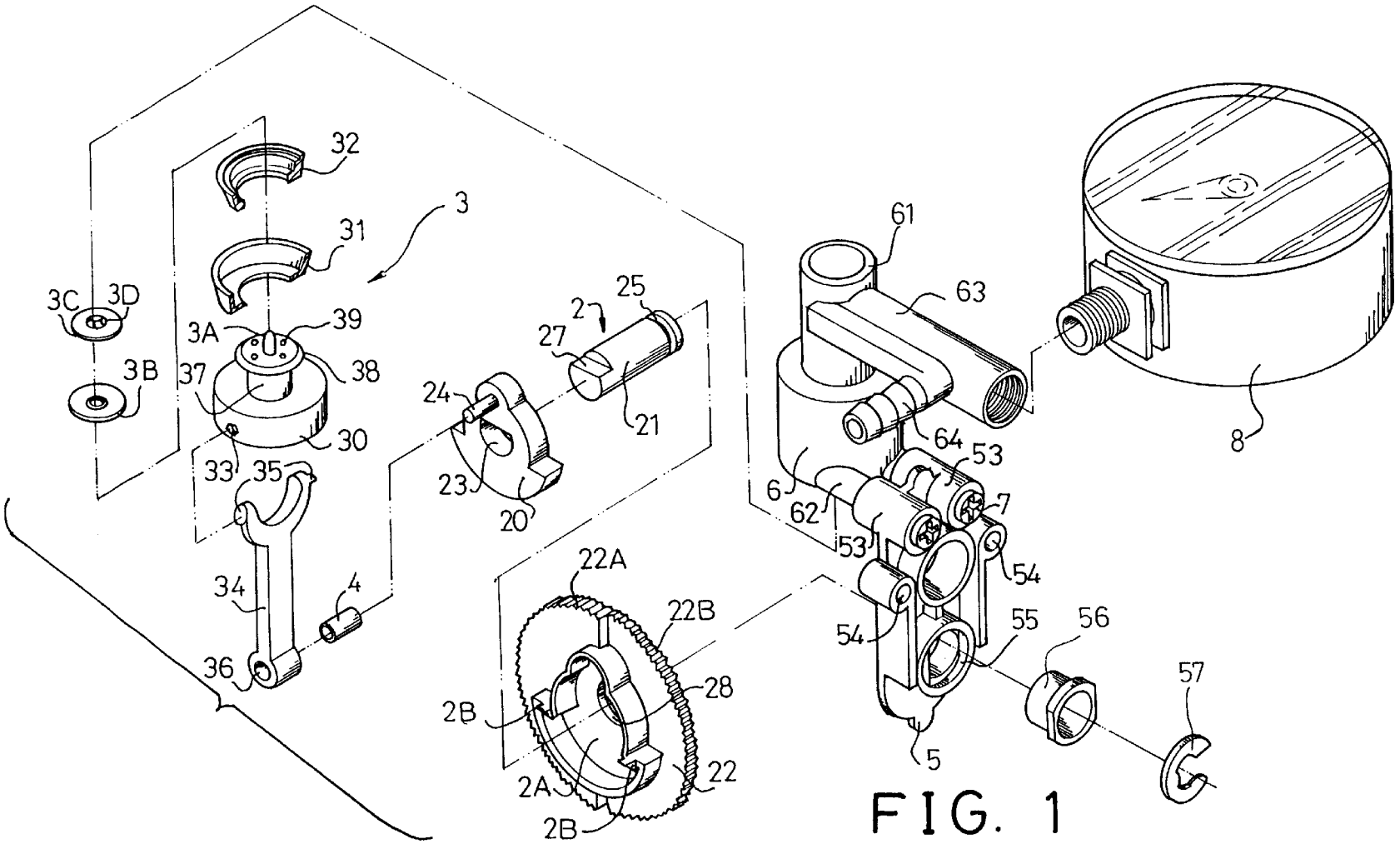
FIG. 1 is an exploded view of an air compressor in accordance with the present invention.
Figure 2:
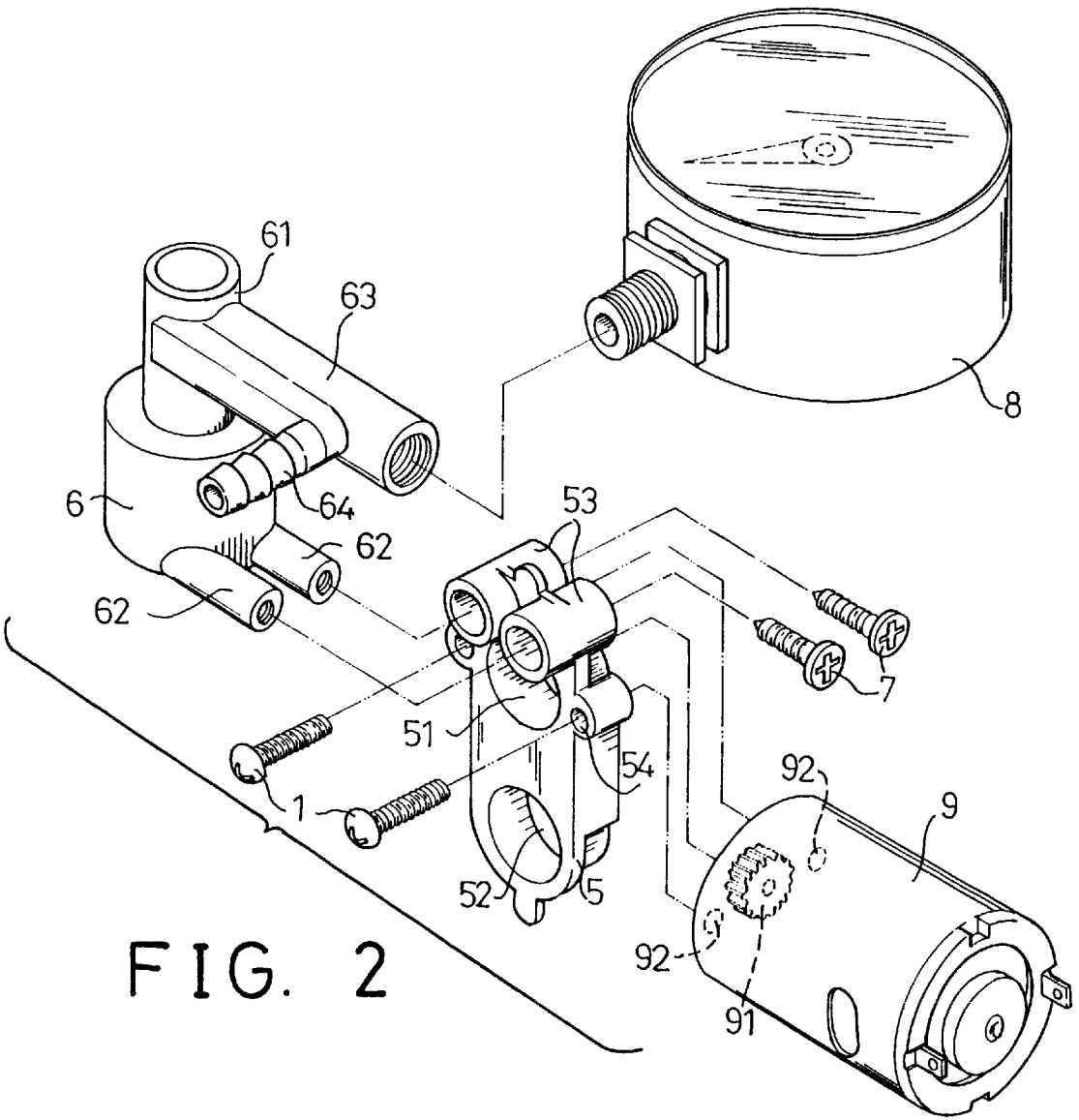
FIG. 2 is a partial exploded view illustrating two separate support members of the air compressor.
Figure 3:
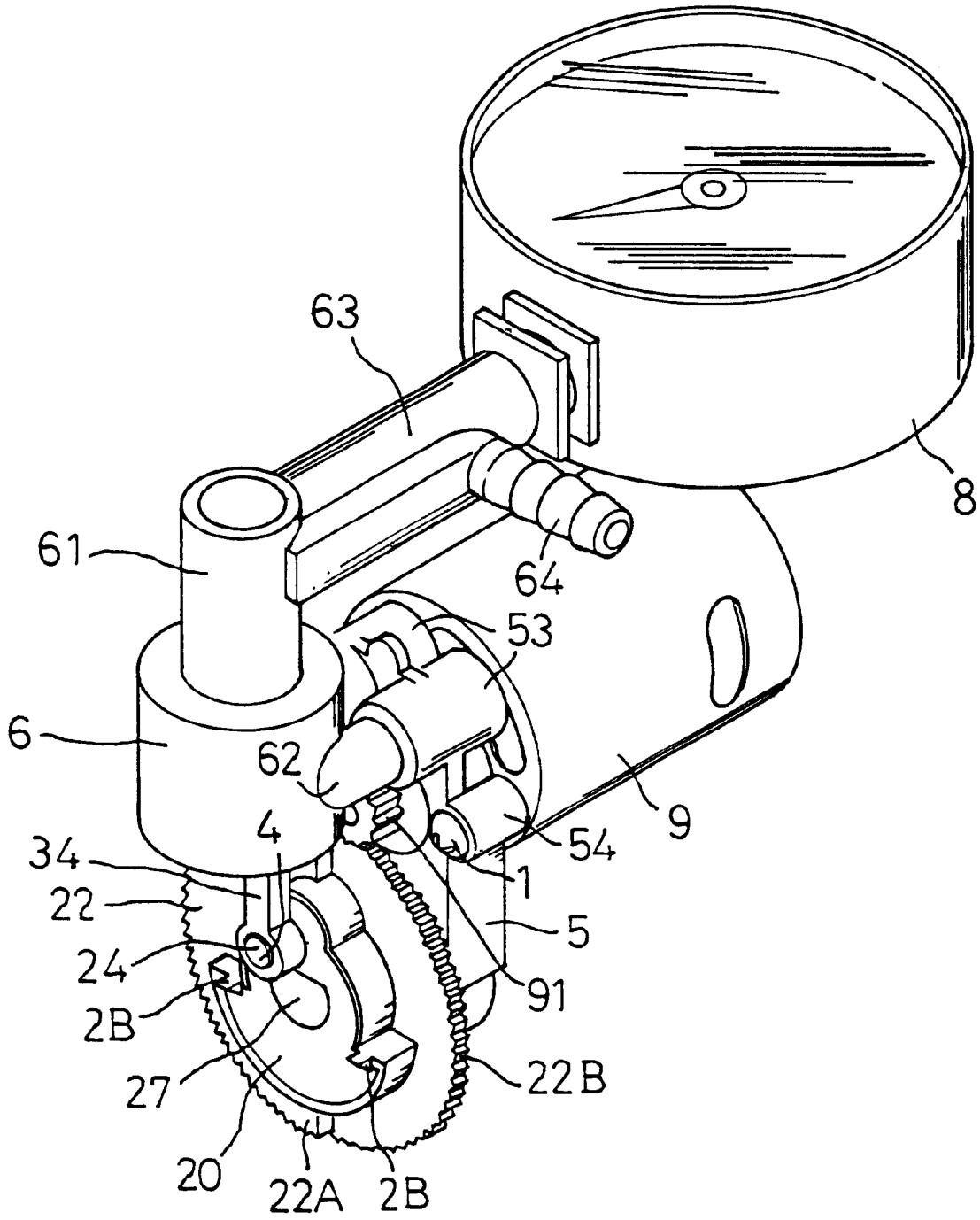
FIG. 3 is a perspective view of the air compressor.
Figure 4:
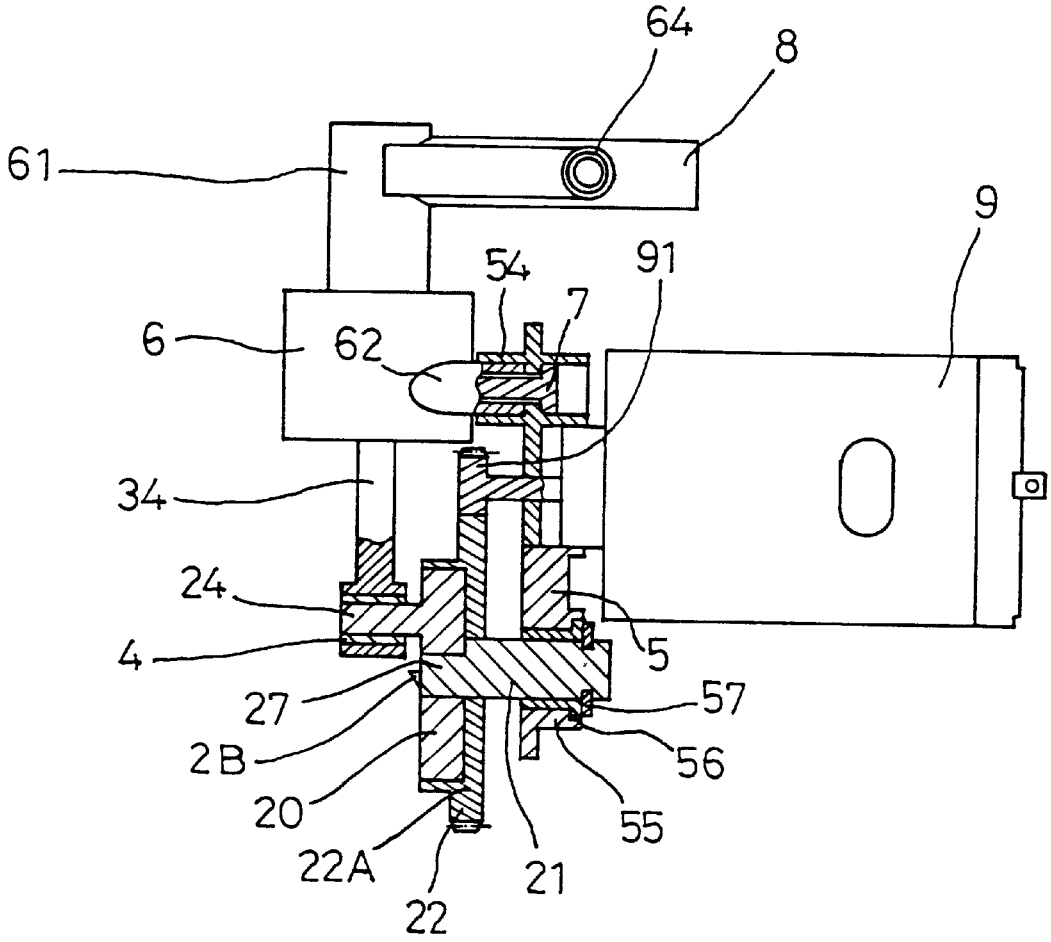
FIG. 4 is a partial cross sectional view illustrating the assembling of the air compressor.

Referring to the drawings, and initially to FIGS. 1–3, an air compressor in accordance with the present invention comprises a cylinder housing 6 including an extension 61 extended upward therefrom and including a tube 63 extended from the extension 61 for coupling a pressure gage 8 thereto with such as a threading engagement. The tube 63 includes an outlet port 64 for output the pressurized air generated by the air compressor. The cylinder housing 6 includes one or more projections 62 extended outward from the bottom portion thereof. A seat 5 includes one or more sleeves 53 for receiving the projections 62 of the cylinder housing 6, and one or more fasteners 7 are threaded with the projections 62 and engaged with the sleeves 53 for securing the seat 5 to the cylinder housing 6 (FIG. 4). The seat 5 includes two holes 54 formed therein for receiving fasteners 1 which may be threaded with the screw holes 92 of the motor 9 for securing the motor 9 to the seat 5. The motor 9 includes a pinion 91 provided thereon and extended through an orifice 51 of the seat 5. The seat 5 includes an aperture 52 formed therein and preferably located below the orifice 51 thereof.

A compression device 3 includes a piston container 30 slidably received in the cylinder housing 6 and includes two holes 33 formed therein. A link 34 includes two pins 35 provided on the upper portion thereof and engaged into the holes 33 of the piston container 30 for pivotally securing the piston housing 30 to the link 34. The link 34 includes a hole 36 formed in the bottom portion thereof for receiving a bushing 4 therein. The piston housing 30 includes a post 37 extended upward therefrom and a disc 38 provided on top of the post 37. A compression valve 31 and a positioning block 32 are engaged onto the post 37 and retained on the post 37 by the disc 38. The post 37 and the disc 38 includes one or more air inlets 39 formed therein and communicating with the interior of the piston container 30. The disc 38 includes a pin 3A extended upward therefrom for receiving a valve piece 3B thereon and a limiting piece 3C includes a fastening portion 3D engaged with the pin 3A for securing the valve piece 3B on the pin 3A.

A transmission device 2 includes a gear 22 having a bore 28 formed therein for receiving a shaft 21 which is engaged through the aperture 52 of the seat 5 for rotatably supporting the gear 22 to the seat 5 (FIG. 4). A gasket 56 is engaged on the shaft 21 and engaged in a recess 55 of the seat 5 (FIG. 1), and a clamping ring 57 is engaged with an annular groove 25 of the shaft 21 for rotatably securing the gear 22 to the seat 5 at the pivot shaft 21. A weight 20 includes a non-circular opening 23 formed therein for receiving a non-circular end 27 of the shaft 21 or is keyed to the shaft 21 so as to be rotated in concert with and driven by the shaft 21. The weight 20 includes an axle 24 extended therefrom and engaged through the bushing 4 for securing to the link 34 and for moving the link 34 up and down when the weight 20 is rotated by the shaft 21. The gear 22 includes a non-circular casing 2A provided therein for receiving the corresponding non-circular weight 20 such that the weight 20 rotates in concert with the gear 22 (FIG. 4). The casing 2A includes two shoulders each having a retaining block 2B extended therefrom for retaining the weights 20 of different thickness in the casing 2A. The gear 22 includes one half having a thick toothed portion 22A and the other half having a thin toothed portion 22B, i.e., having a thickness smaller than that of the thick toothed portion 22A.

In operation, both the weight 20 and the gear 22 may be rotated by the motor 9 with the pinion 91 of the motor 9, in order to move the piston housing 30 up and down with the link 34. The pinion 91 of the motor 9 is engaged with the thick toothed portion 22A of the gear 22 to enhance the air discharge effect of the compressor, and is engaged with the thin toothed portion 22B of the gear 22 to intake the air into the cylinder housing 6. The coefficient of the friction may be increased due to the decreased engaging area between the thin toothed portion 22B of the gear 22 and the pinion 91.

The most important effect of the present invention is that the seat 5 is separated from the cylinder housing 6. The transmission device 3 may be easily and quickly engaged into the cylinder housing 6; and the gear 22 and the transmission device 2 may also be easily and quickly attached onto the seat 5. The seat 5 may then be easily and quickly secured onto the cylinder housing 6, and the axle 24 of the weight 20 may be easily and quickly engaged into the bushing 4 of the link 34, such that the elements of the air compressor may be easily and quickly assembled together.

Accordingly, the air compressor in accordance with the present invention includes an improved structure for allowing the elements of the air compressor to be easily and quickly assembled together.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An air compressor comprising:

a) a cylinder housing including an outlet port, said cylinder housing including at least one projection extended therefrom, b) a pressure gage attached to said cylinder housing, c) a compression device including:

i) a piston container slidably received in said cylinder housing and including a post extended upward therefrom and including a disc provided on top of said post, said disc including a pin extended upward therefrom, ii) a compression valve and a positioning block engaged onto said post and retained on said post with said disc, said post and said disc including at least one air inlet formed therein and communicating with an interior of said piston container, iii) a valve piece engaged on said pin of said disc, iv) a limiting piece including a fastening portion engaged with said pin for securing said valve piece on said pin of said disc, and v) a link including an upper portion pivotally secured to said piston container and including a bottom portion, d) a seat including an orifice formed therein, said seat including at least one sleeve provided therein, said at least one projection of said cylinder housing being engaged into said at least one sleeve of said seat, e) a motor secured to said seat and including a pinion engaged through said orifice of said seat, f) a transmission device including:

i) a gear rotatably securing to said seat at a pivot shaft and engaged with said pinion and driven by said motor via said pinion, said gear including a non-circular casing provided thereon, said gear including a first half having a thick toothed portion provided thereon for engaging with said pinion of said motor and including a second half having a thin toothed portion provided thereon for engaging with said pinion of said motor, said thin toothed portion of said gear including a thickness smaller than that of said thick toothed portion of said gear, ii) a weight including a non-circular shape engaged in said non-circular casing and rotated in concert with said gear, said weight being engaged on said shaft and rotated in concert with said shaft, said weight including an axle extended therefrom and rotatably engaged through said lower portion of said link for moving said link up and down when said weight is rotated by said shaft, and g) means for securing said seat to said cylinder housing.

* * * * *